US005454338A

United States Patent [19]

McEwen et al.

[11] Patent Number: 5,454,338

[45] Date of Patent: Oct. 3, 1995

[54] POSITIVE PRESSURE LINT BARRIER AND OIL COOLER FOR A SEWING MACHINE

[75] Inventors: John McEwen, Mocksville; David Tolzman, Rural Hall; Anthony DiDonato, Winston-Salem, all of N.C.

[73] Assignee: Sara Lee Corporation, Winston-Salem, N.C.

[21] Appl. No.: 274,853

[22] Filed: Jul. 14, 1994

[51] Int. Cl.[6] ..... D05B 71/00; F28F 1/00

[52] U.S. Cl. ..... 112/282; 112/256; 112/280; 165/122; 184/6.15

[58] Field of Search ..... 112/282, 280, 112/287; 15/301, 405; 165/47, 119, 122, 127; 415/219.1; 454/49, 66, 187, 189; 184/6.15, 104.1

[56] References Cited

U.S. PATENT DOCUMENTS

| | | | |
|---|---|---|---|
| 2,432,285 | 12/1947 | Christensen et al. | 112/280 |
| 2,446,261 | 8/1948 | Christensen et al. | 112/282 X |
| 2,447,115 | 8/1948 | Christensen | 112/280 X |
| 2,817,281 | 12/1957 | Schwan et al. | 454/189 |
| 3,486,474 | 12/1969 | Kosrow et al. | 184/6.15 X |
| 3,638,594 | 2/1972 | Armstead, Jr. et al. | 112/280 |
| 3,771,478 | 11/1973 | Tranquilla et al. | 112/280 |
| 4,699,208 | 10/1987 | Wolf et al. | 165/47 |
| 4,709,645 | 12/1987 | Jones et al. | 112/282 |

FOREIGN PATENT DOCUMENTS

| | | | |
|---|---|---|---|
| 0599677 | 11/1959 | Italy | 112/282 |
| 0129123 | 8/1993 | Japan | 454/187 |

*Primary Examiner*—C. D. Crowder
*Assistant Examiner*—Ismael Izaguirre
*Attorney, Agent, or Firm*—Rhodes, Coats & Bennett

[57] ABSTRACT

A lint barrier for a sewing machine which excludes lint from entering the interior of the sewing machine having a machine housing enclosing the internal workings of the machine. The sewing machine also includes an oil cooler adapted to cool oil circulating through the sewing machine, the cooler including a radiator and an air source for moving air through the radiator. A conduit connects the air source to the interior of the sewing machine, whereby air is conducted through the conduit and into the interior of the sewing machine to maintain a positive pressure within the sewing machine interior, thereby preventing the entry of lint into the sewing machine interior.

15 Claims, 3 Drawing Sheets

POSITIVE PRESSURE LINT BARRIER AND OIL COOLER FOR A SEWING MACHINE

BACKGROUND OF THE INVENTION

1. Field of the Invention

The present invention relates generally to sewing machines and, more particularly, an apparatus for excluding lint from the interior of a sewing machine.

2. Description of the Prior Art

One of the major problems in commercial sewing operations is lint. Once lint from the garment piece contacts oil from the sewing machine, it will spot fabric fed to the machine, wick oil from the machine and clog critical parts within the machine. Over the years, many approaches have been tried to solve the problem of lint. Operators have used vacuum and air blowing systems to try to prevent accumulation of lint.

For example, U.S. Pat. No. 4,709,645, issued to Jones et al., discloses a waste fabric and lint collection box for a sewing machine connected to a vacuum source in a waste removal system.

None of these systems have been entirely successful. The problem is now understood that once the lint contacts oil in the machine, no amount of vacuum or blowing can remove it from the machine or prevent it from spotting garments.

Thus, there remains a need for a new and improved lint barrier for a sewing machine which is operable to prevent lint from entering the interior of the sewing machine, thereby preventing spots on garments, oil loss and damage to critical parts within the machine.

SUMMARY OF THE INVENTION

The present invention is directed to a sewing machine having a lint barrier which excludes lint from entering the interior of the sewing machine having a machine housing enclosing the internal workings of the machine. The sewing machine also includes an oil cooler adapted to cool oil circulating through the sewing machine, the cooler including a radiator and an air source for moving air through the radiator. A conduit connects the air source to the interior of the sewing machine, whereby air is conducted through the conduit and into the interior of the sewing machine to maintain a positive pressure within the sewing machine interior, thereby preventing the entry of lint into the sewing machine interior.

Accordingly, one aspect of the present invention is to provide an apparatus for excluding lint from a sewing machine interior. The apparatus includes: (a) an air conduit having an outlet in communication with the sewing machine interior and an air inlet; and (b) an air source in communication with the air inlet, whereby air entering the air inlet and exiting the outlet produces a positive pressure in the sewing machine interior, thereby preventing the entry of lint into the sewing machine interior.

Another aspect of the present invention is to provide a sewing machine. The sewing machine includes: (a) a machine housing; (b) an oil cooler adapted to cool oil circulating through the sewing machine, the cooler including a radiator and an air source for moving air through the radiator; (c) a conduit having an inlet end in communication with the air source and an outlet end in communication with the interior of the sewing machine, whereby air is conducted through the conduit and into the interior of the sewing machine to maintain a positive pressure within the sewing machine interior, thereby preventing the entry of lint into the sewing machine interior.

Still another aspect of the present invention is to provide a method of excluding lint from the interior of a sewing machine. The method includes the steps of: (a) producing air under pressure; and (b) directing the pressurized air into the sewing machine interior to maintain a positive pressure within the sewing machine interior, thereby preventing the entry of lint into the sewing machine interior.

These and other aspects of the present invention will become apparent to those skilled in the art after a reading of the following description of the preferred embodiment when considered with the drawings.

DESCRIPTION OF THE PREFERRED EMBODIMENTS

Figure 1:
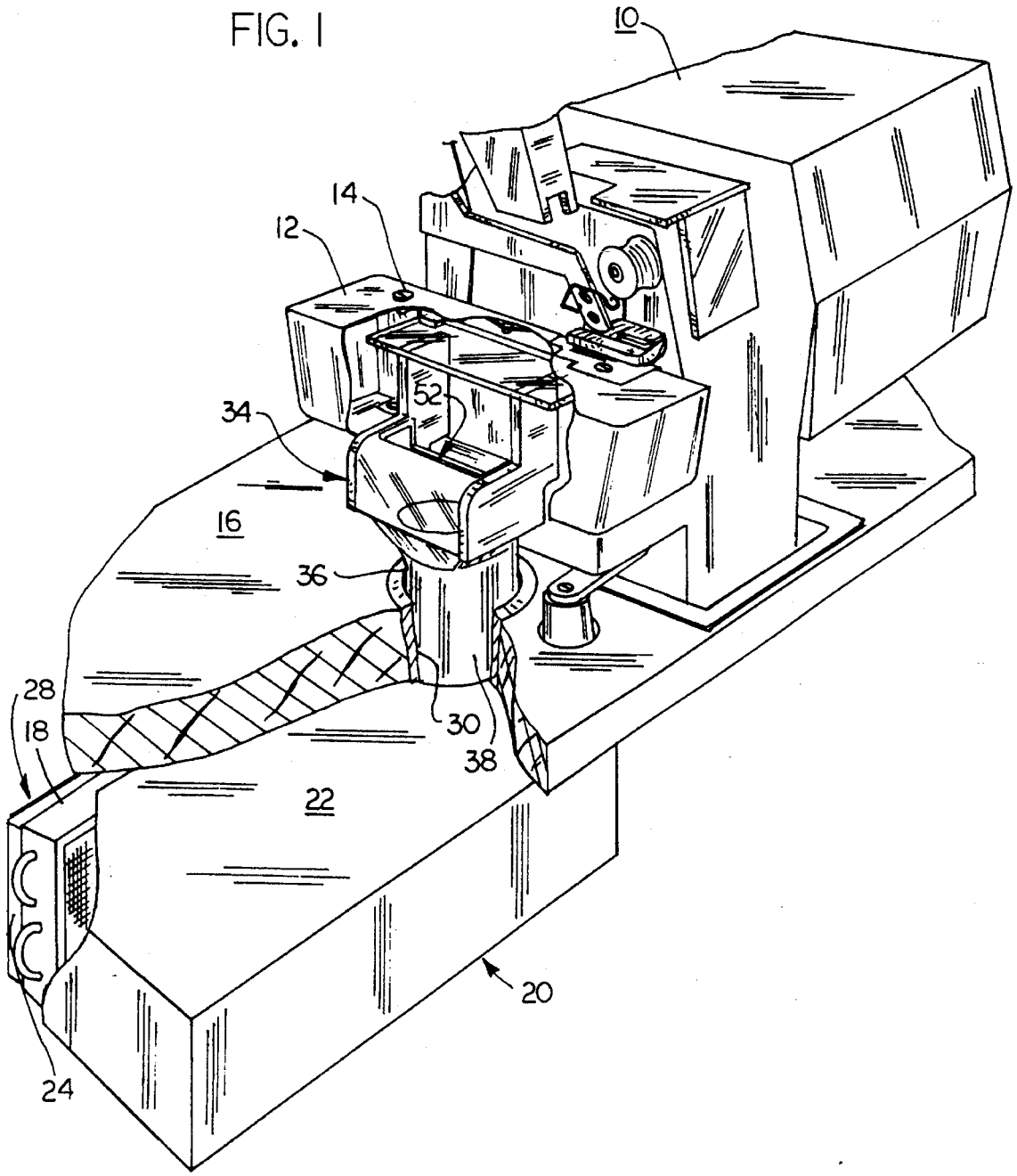
FIG. 1 is a perspective view of a commercial sewing machine with an air diverter constructed according to the present invention installed.
Figure 2:
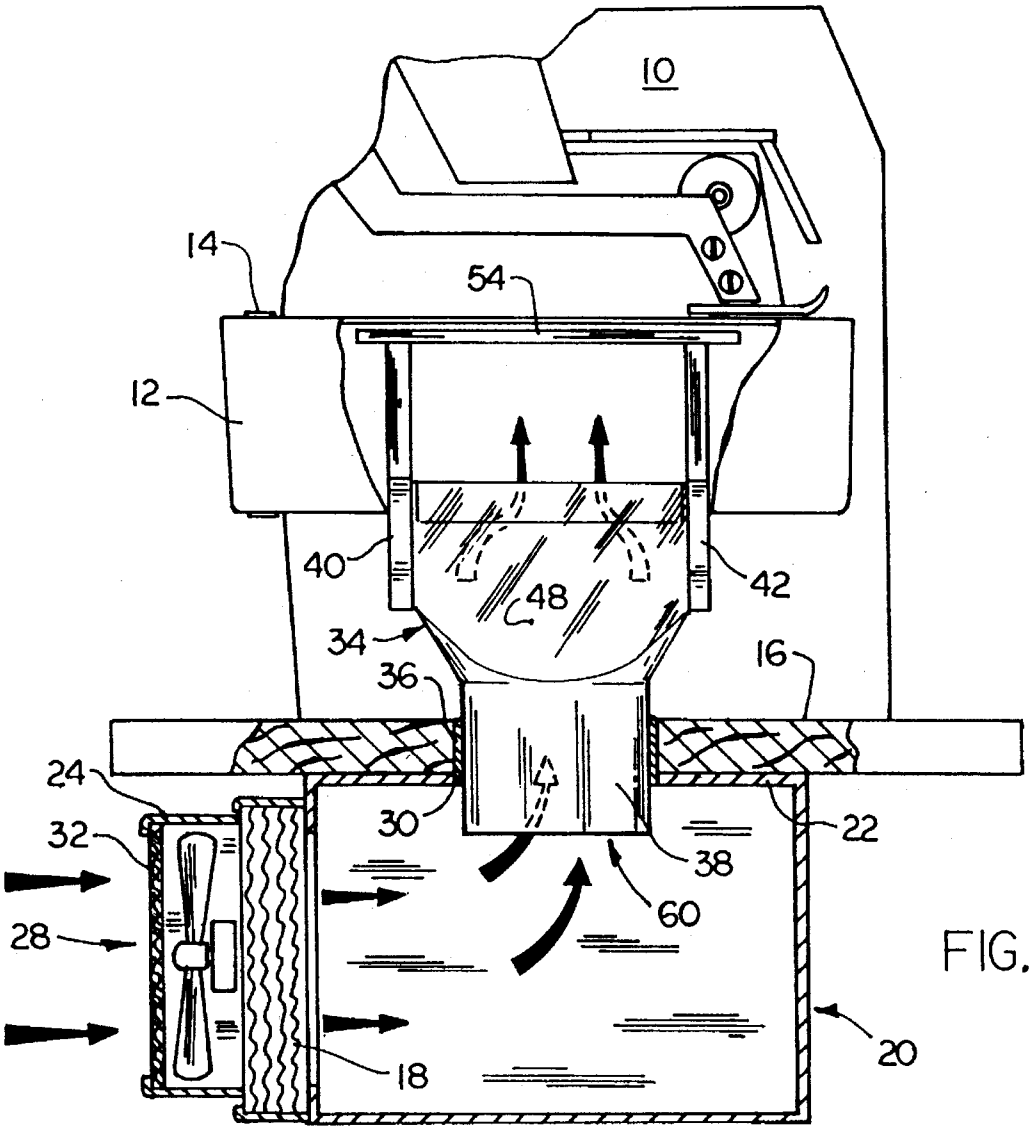
FIG. 2 is a partial sectional view of the sewing machine and air diverter illustrated in FIG. 1.

In the following description, like reference characters designate like or corresponding parts throughout the several views. Also in the following description, it is to be understood that such terms as "forward", "rearward", "left", "right", "upwardly", "downwardly", and the like are words of convenience and are not to be construed as limiting terms.

Referring now to the drawings in general and FIG. 1 in particular, it will be understood that the illustrations are for the purpose of describing a preferred embodiment of the invention and are not intended to limit the invention thereto. As best seen in FIG. 1, an industrial sewing machine is shown having an air diverter constructed according to the present invention installed.

The sewing machine, in the absence of the improvements added by the present invention, is of a conventional design, and thus is not illustrated or described in detail. The sewing machine shown is a model 39500 manufactured by Union Special of Huntley, Ill. and includes a housing 10 enclosing the internal workings of the sewing machine including shuttle/hook and bobbin case. Access to the internal components within housing 10 is by way of cover 12 connected to housing 10 by hinge 14. The sewing machine is supported above a table 16 and driven by an external motor by a belt.

Since industrial sewing machines operate at very high speeds, e.g., 9000 stitches per minute, it is necessary to circulate oil about the critical moving parts. The oil, heated by friction from the moving parts, is cooled by passing it through a radiator 18, mounted below table 16. In the usual industrial sewing machine, the oil passing through the radiator 18 is cooled by blowing air from an air source through the radiator. However, in the present invention, oil passing through the radiator is cooled by drawing air into the radiator, i.e., the air is pulled through the radiator by a negative pressure as opposed to forcing air through the radiator by positive air pressure as is conventionally done. This is accomplished by mounting radiator 18 adjacent a cooling air supply, generally designated 20, consisting of an air source housing 22 which includes a plenum enclosing a fan 24 driven by a electric motor. Housing 22 has an inlet 28 adjacent to the radiator 18 and an outlet 30. A filter 32 is positioned over inlet 28 to restrict the entry of dust into the interior of housing 22.

The reversal of the air flow through the radiator and into the housing enables the air source to also be used to produce a positive flow of air into the interior of the sewing machine by directing the air exhausted from air source 20 through an air diverter, generally designated 34, thereby pressurizing the interior of the sewing machine.

Figure 4:
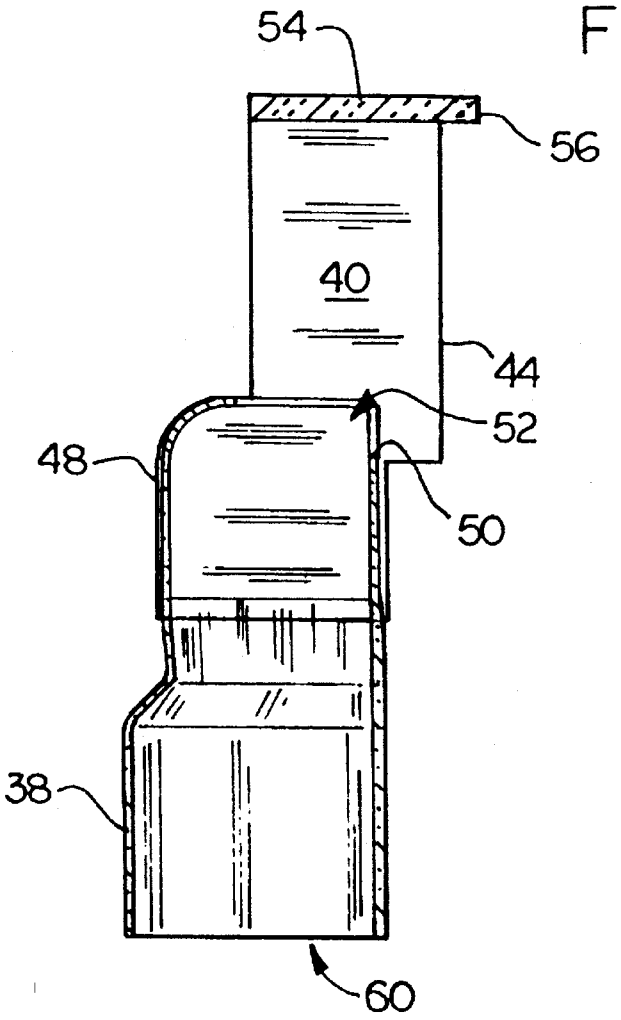
FIG. 4 is an enlarged side view of the air diverter illustrated in FIG. 3 taken along line 4—4.
Figure 3:
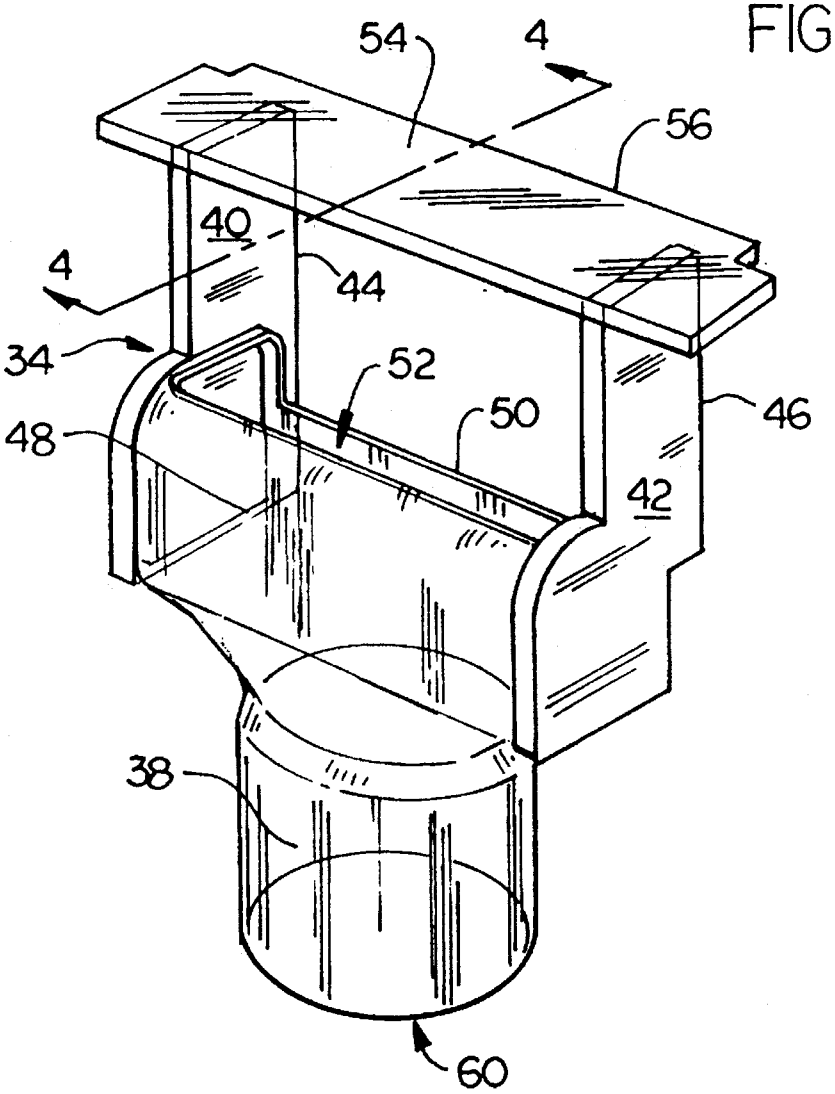
FIG. 3 is an enlarged perspective view of the air diverter.

As best illustrated in FIGS. 3 and 4, air diverter 34 has an inlet in communication with air source 20 by way of tube 38 connected to housing outlet 30 and an air outlet 52 in communicating with the interior of the sewing machine. Air diverter 34 extends upwardly from air source 20 to the sewing machine through an opening 36 in table 16.

Air diverter 34 includes tube 38 and an air discharge chamber formed by a pair of spaced side walls 40 and 42 having front edges 44 and 46, respectively, a curved rear wall 48 and a front wall 50. The upper edge of front wall 50 is spaced from the forward edge of rear wall 48 to form a discharge port 52 therebetween. A horizontal top wall 54 joins the upper edges of side walls 40 and 42 and is spaced above port 52. Top wall 54 includes a leading edge 56 which, along with leading edges 44 and 46 of side walls 40 and 42, respectively, are shaped to the configuration of the sewing machine to provide a close fit adjacent the sewing machine interior. The lower edges of walls 40, 42, 48 and 50 are joined to the upper edge of pipe 38 which has an inlet end 60 opposite discharge port 52.

Cover 12 is rotatable about hinge 14 between an open position and a closed position. When cover 12 is in the open position, air diverter 34 can be positioned within or removed from opening 36 in table 16. In order to provide a positive air pressure within the interior of the sewing machine, air diverter 34 is positioned within opening 36, with the leading edges 44, 46 and 56 walls 40, 42 and 54, respectively, adjacent the interior of the sewing machine. Cover 12 is then rotated about hinge 14 to a closed position in which it cooperates with the walls of diverter 38 to direct air into the sewing machine interior.

Operation of the apparatus and attendant process is both simple and effective. Air produced by air source 20 is drawn into the plenum formed by housing 22 through air inlet 28 and is discharged from housing 22 through outlet 30 connected to tube 38. The discharged air is then conveyed through air diverter 34 into the interior of the sewing machine by entering inlet 60 of conduit 38 and flowing upwardly into the air diverter, where it is exhausted through discharge port 52. As a result of the cooperation of walls 40, 42, 48 and 54, and the cooperation of cover 12, air is forced into the sewing machine interior producing a positive pressure within the interior of the sewing machine. This prevents lint and other airborne particles from entering the interior of the machine and forming a solid with the oil in the machine.

In the preferred embodiment, air is directed into the sewing machine interior at a rate of up to about 350 cubic feet per minute (10,000 liters per minute). However, it will be understood that some sewing machines may have less openings and, accordingly, a lower air flow rate will be sufficient. Also, in the preferred embodiment, it has been found that the air directed into the sewing machine interior only requires a pressure of between about 0.05 and 0.5 inches of water (1.3 and 13 millimeters of water) in order to be effective. This is surprising in view of the prior art air and vacuum systems which produced substantially-larger pressure differentials.

Certain modifications and improvements will occur to those skilled in the art upon a reading of the foregoing description. By way of example, the shape of the air diverter, especially the leading edges of the side walls, can be modified to fit other machine configurations. Also, the structure of the air diverter can be such that the air is directed into the interior of the sewing machine by the air diverter configuration without any cooperation from the machine cover. In addition, the air source used to direct air into the sewing machine interior can be different from the air source used to cool the oil. Furthermore, when using a common air source to cool oil passing through the radiator and to maintain a positive pressure within the interior of the sewing machine, the air source can blow air through the radiator and into the housing, instead of drawing the air through the radiator as shown in the preferred embodiment. Finally, the invention can be practiced without using a radiator or coiling coil by using a fan in an enclosure or other source of clean, low pressure air. It should be understood that all such modifications and improvements have been deleted herein for the sake of conciseness and readability but are properly within the scope of the following claims.

We claim:

1. A sewing machine comprising:

(a) a machine housing;

(b) an oil cooler adapted to cool oil circulating through said sewing machine, said cooler including a radiator and an air source for moving air through said radiator;

(c) a conduit having an inlet end in communication with said air source and an outlet end in communication with the interior of said sewing machine, whereby air is conducted through said conduit and into the interior of said sewing machine to maintain a positive pressure within said sewing machine interior, thereby preventing the entry of lint into said sewing machine interior; and (d) a table having an opening therein, said sewing machine interior being positioned above said table, said air source and radiator being positioned below said table, and said conduit extending through said opening from said air source to said sewing machine interior.

2. The sewing machine according to claim 1, wherein said air source includes a housing having an inlet and an outlet, and a fan within said housing, said radiator being adjacent said inlet and said conduit inlet end being in communication with said outlet, whereby said fan draws air through said radiator and said housing inlet and exhausts air from said housing through said housing outlet and said conduit into said machine sewing interior.

3. The sewing machine according to claim 1, further including an air deflection chamber at the outlet end of said conduit.

4. The sewing machine according to claim 3, further including a cover hingedly connected to said machine housing, said cover being moveable between an open position and a closed position, whereby said cover acts in cooperation with said air deflection chamber to direct air into the sewing machine interior when said cover is in a closed position.

5. The sewing machine according to claim 3, wherein said air deflection chamber includes a bottom wall, a rear wall extending upwardly from said bottom wall, a pair of opposed side walls having rear edges joined to said rear wall, lower edges joined to said bottom wall, and front edges adjacent said sewing machine interior.

6. The sewing machine according to claim 5, wherein the front edges of the side walls are shaped to conform to the shape of the sewing machine interior.

7. The sewing machine according to claim 5, wherein said air deflection chamber further includes a top wall above said side walls.

8. The sewing machine according to claim 1, further including a pipe having an outlet end communicating with said air deflection chamber and an inlet end communicating with said air source.

9. A sewing machine comprising:

(a) a machine housing;

(b) an oil cooler adapted to cool oil circulating through said sewing machine, said cooler including a radiator and an air source for moving air through said radiator;

(c) a conduit having an inlet end in communication with said air source and an outlet end in communication with the interior of said sewing machine, whereby air is conducted through said conduit and into the interior of said sewing machine to maintain a positive pressure within said sewing machine interior, thereby preventing the entry of lint into said sewing machine interior;

(d) an air deflection chamber at the outlet end of said conduit; and (e) a cover hingedly connected to said machine housing, said cover being moveable between an open position and a closed position, whereby said cover acts in cooperation with said air deflection chamber to direct air into the sewing machine interior when said cover is in a closed position.

10. The sewing machine according to claim 9, wherein said air source includes a housing having an inlet and an outlet, and a fan within said housing, said radiator being adjacent said inlet and said conduit inlet end being in communication with said outlet, whereby said fan draws air through said radiator and said housing inlet and exhausts air from said housing through said housing outlet and said conduit into said machine sewing interior.

11. The sewing machine according to claim 9, further including a table having an opening therein, said sewing machine interior being positioned above said table, said air source and radiator being positioned below said table, and said conduit extending through said opening from said air source to said machine sewing machine interior.

12. The sewing machine according to claim 9, wherein said air deflection chamber includes a bottom wall, a rear wall extending upwardly from said bottom wall, a pair of opposed side walls having rear edges joined to said rear wall, lower edges joined to said bottom wall, and front edges adjacent said sewing machine interior.

13. The sewing machine according to claim 12, wherein the front edges of the side walls are shaped to conform to the shape of the sewing machine interior.

14. The sewing machine according to claim 12, wherein said air deflection chamber further includes a top wall above said side walls.

15. The sewing machine according to claim 9, further including a pipe having an outlet end communicating with said air deflection chamber and an inlet end communicating with said air source.

* * * * *